United States Patent [19]

Olson

[11] 4,351,803

[45] Sep. 28, 1982

[54] HYDROCARBON HEATING APPARATUS

[75] Inventor: John S. Olson, Borger, Tex.

[73] Assignee: Phillips Petroleum Company, Bartlesville, Okla.

[21] Appl. No.: 270,727

[22] Filed: Jun. 5, 1981

Related U.S. Application Data

[62] Division of Ser. No. 128,991, Mar. 10, 1980, Pat. No. 4,293,402.

[51] Int. Cl.[3] ..... B01D 1/00; B01D 1/14; B01J 8/00; B01J 19/24

[52] U.S. Cl. ..... 422/106; 196/104; 196/107; 196/132; 196/134; 422/111; 422/112; 422/198; 422/201

[58] Field of Search ..... 208/48 R, 93, 211, 213, 208/347, 364, 365; 196/104–107, 134, 132; 422/201, 198, 1 DG, 111, 112

[56] References Cited

U.S. PATENT DOCUMENTS

| | | | |
|---|---|---|---|
| 1,835,765 | 12/1931 | Egloff et al. . | |
| 2,469,325 | 5/1949 | Branson | 208/93 |
| 3,077,448 | 2/1963 | Kardash et al. | 208/210 |
| 3,206,395 | 9/1965 | Slyngstad et al. | 196/134 |
| 3,223,746 | 12/1965 | Hammond et al. | 196/134 |
| 3,591,489 | 7/1971 | Adams et al. | 208/211 |
| 3,850,743 | 11/1974 | Pelser et al. | 208/213 |
| 4,264,432 | 4/1981 | Gartside | 208/48 R |

*Primary Examiner*—Bradley Garris

[57] ABSTRACT

Hydrocarbons are preheated, particularly for a hydrodesulfurization process by first heating the hydrocarbon stream to produce a vapor and a liquid stream, thereafter superheating at least some of the vapor phase and mixing the superheated vapor phase with the liquid phase to generate the hydrocarbon feedstream at the desired temperature. By this procedure only the evaporated hydrocarbons are subjected to a high temperature, but not the heavier hydrocarbons.

2 Claims, 1 Drawing Figure

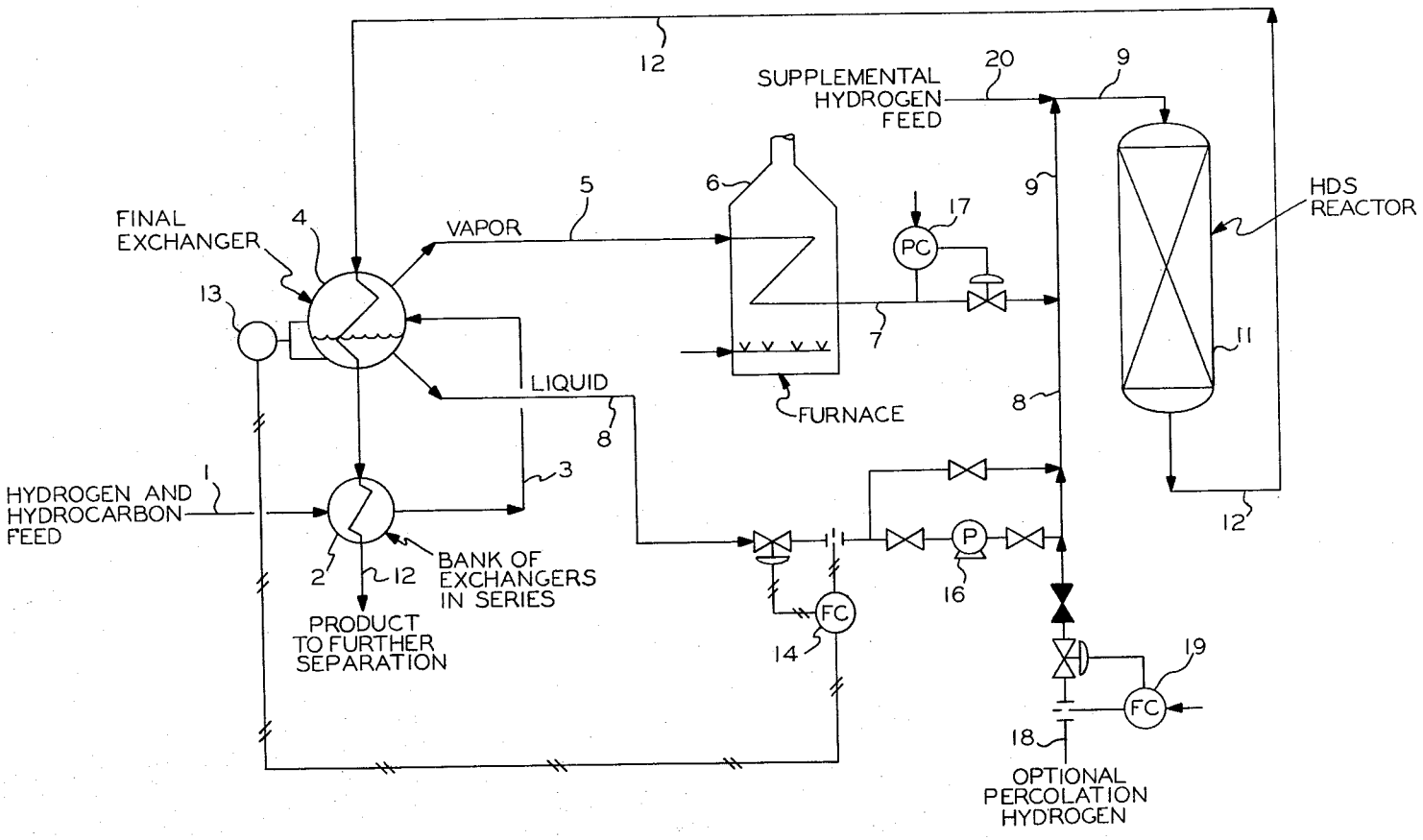
HDS REACTOR
11
12
9
20
SUPPLEMENTAL HYDROGEN FEED
17
PC
7
FURNACE
6
12
5
VAPOR
LIQUID
8
3
BANK OF EXCHANGERS IN SERIES
12
PRODUCT TO FURTHER SEPARATION
2
4
FINAL EXCHANGER
13
1
HYDROGEN AND HYDROCARBON FEED
14
FC
16
P
8
9
19
FC
18
OPTIONAL PERCOLATION HYDROGEN

HYDROCARBON HEATING APPARATUS

This application is a division of application Ser. No. 128,991, filed Mar. 10, 1980, now U.S. Pat. No. 4,293,402.

This invention relates to the heating of hydrocarbons in a defined, controllable and non-rigid manner. Another aspect of this invention is a hydrodesulfurization process. An apparatus for hydrocarbon heating and processing is yet a further aspect of this invention.

BACKGROUND OF THE INVENTION

In several hydrocarbon processes and process steps, it is necessary to heat the hydrocarbon. To obtain well-defined conditions and a controllable operation it is frequently desirable to be able to heat or preheat hydrocarbons without hydrocarbon conversion, or at least without inaccurately defined hydrocarbon conversion and without side reactions leading to polymers, gums, and other undesired by-products.

STATEMENT OF THE INVENTION

Thus, it is one object of this invention to provide a process for heating hydrocarbons utilizing the inherent properties of the hydrocarbon molecules of different size to provide a well defined process for heating hydrocarbons.

Another object of this invention is to provide a process for heating hydrocarbons that has little or no influence on the chemical composition of the hydrocarbons so heated.

A further object of this invention is a hydrocarbon heating process in which cracking of the larger hydrocarbon molecules is avoided.

Yet another object of this invention is to provide new hydrodesulfurization process involving a less strigent preheating step than heretofore feasible.

Still a further object of this invention is to provide an apparatus within which hydrocarbons can be processed at elevated temperatures.

These and other objects, advantages, details, features and embodiments of this invention will become apparent to those skilled in the art from the following detailed description of the invention and the appended claims as well as the attached drawing which shows a schematic flow diagram of a hydrodesulfurization unit.

In accordance with this invention a hydrocarbon feedstream at a given input temperature is provided, a hydrocarbon stream is gently heated to a temperature below said input temperature; a lighter hydrocarbon fraction from the hydrocarbon stream is evaporated and separated from the remaining liquid phase; at least a portion of this hydrocarbon vapor phase is heated to a temperature above the input temperature; at least a portion of the hydrocarbon liquid phase and the heated hydrocarbon vapor phase are mixed and the temperature and quantities of the two phases being selected so that the hydrocarbon feedstream obtained by mixing the heated hydrocarbon vapor phase and the hydrocarbon liquid phase portions is at the input temperature. The hydrocarbon feedstock thus heated is passed through a process zone in which it is subjected to one or more chemical or physical process steps.

The heating procedure of this invention has the advantage that none of the heavier hydrocarbons are contacted with very hot surfaces, but only the lighter hydrocarbons are; these lighter hydrocarbons do not crack as readily as the heavier hydrocarbons and the heating process of this invention therefore is milder and the overall result is more readily controlled.

The first heating step for evaporating part of the liquid hydrocarbon in the hydrocarbon stream can be achieved by conventional means such as steam boiling. Preferably, however, this first heating step is carried out by subjecting the hydrocarbon stream to indirect heat exchange with at least a portion of the effluent stream leaving the process zone, provided this effluent is at a temperature sufficiently above the temperature of the starting hydrocarbon stream to effect at least some evaporation thereof.

Another embodiment of this invention is a hydrodesulfurization process with improved feedstream preheating. This process comprises introducing a hydrocarbon feedstream preheated as described above together with hydrogen into a hydrodesulfurization zone then into contact with a hydrodesulfurization catalyst under conditions suitable for hydrodesulfurization. In this embodiment, too, it is preferred to pass the effluent from the hydrodesulfurization zone into indirect heat exchange with the incoming hydrocarbon stream to effect at least a part of the evaporation of the lighter hydrocarbons in this hydrocarbon stream.

Hydrocarbon feedstocks useful for the hydrodesulfurization process of this invention comprise those containing 0.03 to 10 percent by weight sulfur of hydrocarbon. The hydrocarbon feedstock contemplated for the hydrodesulfurization process can be generally characterized as a feedstock boiling in the range of 65° to 460° C. The preferred feedstocks for this hydrodesulfurization process are hydrocarbon feedstocks boiling in the range of 70° to 330° C. The typical operating parameters of a hydrodesulfurization zone are shown in the following tabulation. These operating parameter ranges are contemplated for standard hydrodesulfurization catalyst systems such as cobalt-molybdenum, nickel-molybdenum, and the like, conventional hydrodesulfurization catalysts.

TABLE I

| Hydrodesulfurization Operating Conditions | |
|---|---|
| Temperature | 200 to 500° C. |
| Pressure | 200 to 1000 psig |
| Hydrogen Partial Pressure | 20 to 800 psig |
| Gas Volume Hourly Space Velocity (vol. of vapor feed per vol. catalyst/hr. GHSV) | 20 to 100 ACF/CF/HR |
| Hydrogen Feed Rate | 1.0 to 100 SCF/GAL |

Further details concerning the process steps, the apparatus and the catalyst in the hydrodesulfurization process are well known in the art and reference is made to U.S. Pat. Nos. 3,172,843; 3,077,448; and 4,116,816 containing additional information concerning this process.

Yet a further embodiment of the invention is an apparatus useful for processes involving preheating of hydrocarbon feedstreams. The apparatus of this invention comprises a hydrocarbon processor, a hydrocarbon preheater, a gas/liquid separator, a hydrocarbon vapor heater and a hydrocarbon vapor/liquid mixing unit. These units are operatively connected with each other as follows: A hydrocarbon feed conduit is connected to the feed intake side of the hydrocarbon preheater. The hydrocarbon outlet of this preheater is connected to the liquid/gas separator. The gas outlet of the liquid/gas separator is connected to the inlet of the hydrocarbon vapor heater. The outlet of the hydrocarbon vapor heater and the liquid outlet of the liquid/gas separator are connected to the mixing unit. This mixing unit may just be a conduit connection and serves for mixing of the heated hydrocarbon vapor in the hydrocarbon liquid. The outlet of the mixing unit is connected to the inlet of the hydrocarbon processor. This hydrocarbon processor can for instance be a hydrodesulfurization reactor.

Preferably, the hydrocarbon preheater and the gas/-liquid separator are built as one indirect heat exchanger, the last stage of which constitutes the gas/liquid separator and has a gas outlet and a liquid outlet. The indirect heat exchanger has a first flowpath and an indirect heat exchanger relationship with a second flowpath. Thus, latent heat of the processor effluent is used to effect at least some of the preheating of the hydrocarbon stream, the inlet of the first flowpath. Thus, some of the latent feed of the processor effluent is used to effect some of the preheating of the hydrocarbon feedstream.

The following is a process flow description in connection with the attached drawing.

An admixture of hydrogen and hydrocarbon, such as a sulfur-containing naphtha or distillate which hydrocarbon is to be desulfurized, is passed via conduit 1 into the shell side of shell tube heat exchanger 2 (this is a bank of shell-tube heat exchangers operated in series) to indirectly heat the mass and partially vaporize the hydrocarbon. The mass is then passed via 3 to the shell side of the final shell-tube heat exchanger 4. Vapor 5 from exchanger 4 is further heated in furnace 6 and is passed via 7 along with the liquid (heaviest components of the feed 1) recovered from exchanger 4 via 8 and the readmixture is passed via 9 to hydrodesulfurizing unit 11. The now super heated vapor 7 from furnace 6 effects vaporization of liquid 8 in conduit 9. By not putting this heavy liquid 8 into the furnace, but by operating as disclosed, coking in the furnace, which occurs when the heavy liquid is charged thereto, is eliminated. Prior art operation did not separate this heavy liquid 8 from vapor 5, but charged the mass directly together to furnace 6 with coking occurring due to cracking of the heavy liquid components in the furnace tubes.

Desirably, a liquid level control means 13 on exchanger 4 manipulates the flow control means 14 controlling the rate of flow of liquid 8 from exchanger 4 to conduit 9. Optionally, as needed, pump 16 can be used to move liquid 8 into conduit 9. Back pressure control means 17 can be used on conduit 7 through which the heated vapor 7 from furnace 6 is passed. Optionally, hydrogen 18 can be used, as percolation gas, to move the liquid in conduit 8, and flow control means 19 is associated therewith. Supplemental hydrogen can be added via conduit 20. Reactor effluent 12 is indirectly cooled as it indirectly heats the streams in conduits 1 and 3 in heat exchangers 2 and 4, respectively.

| (B) CALCULATED EXAMPLE (See the Drawing) | | |
|---|---|---|
| (1) | Feed: | |
| | Distillate: | |
| | Pounds/hr., | 230,000 |
| | Boiling range, °F., | 150 to 850 |
| | Wt. % Sulfur, | 0.1 |
| | Hydrogen: | |
| | SCF/Bbl of Distillate, | 28 |
| | Temperature, °F., | 220 |
| | Pressure, psig., | 280 |
| (5) | Vapor (contains all of added $H_2$): | |
| | Distillate Vapor, wt. % of Distillate Feed | 93 |
| | Temperature, °F., | 420 |

-continued

| (B) CALCULATED EXAMPLE (See the Drawing) | | |
|---|---|---|
| | Pressure, psig., | 265 |
| (7) | Vapor (same composition as (5): | |
| | Temperature, °F., | 485 |
| | Pressure, psig., | 235 |
| (8) | Liquid: | |
| | Distillate, wt. % of Distillate Feed, | 7 |
| | Estimated Boiling Range, °F., | 210 to 850 |
| | Temperature, °F., | 420 |
| | Pressure, psig., | 265 |
| (20) | Supplemental hydrogen feed | — |
| (9) | Admixture of (5) and (8) and (20): | |
| | Temperature, °F., | 480 |
| | Pressure, psig., | 235 |
| | Hydrogen, SCF/Bbl of Distillate (Substantially all vapor) | 210 |
| (12) | Product (from exchanger 2): | |
| | Distillate: | |
| | Pounds/hr. | 232,000 |
| | Wt. % Sulfur, | 0.1 |
| | Temperature, °F., | 330 |
| | Pressure, psig., (Includes hydrogen and produced $H_2S$, etc.) | 205 |
| (11) | Reactor Operation: | |
| | Temperature (average), °F., | 480 |
| | Pressure, psig., | 235 |
| | Vol. of Vapor/Vol. Cat./hr, ACF/CF/HR | 74 |

The catalyst contemplated for this calculated example is nickel-molybdenum catalyst on alumina base.

Reasonable variations and modification which will become apparent to those skilled in the art can be made in this invention without departing from the spirit and scope thereof.

I claim:

1. Apparatus for treating hydrocarbon containing feedstream comprising (a) a hydrocarbon feed conduit connected to the feed intake side of (b) a hydrocarbon preheater, the hydrocarbon outlet of which is connected to (c) a liquid/gas separator having a gas outlet and a liquid outlet, the gas outlet of said liquid/gas separator being connected to (d) the inlet of a hydrocarbon vapor super heater the outlet of which is connected to one of two inlets of (e) a mixing unit, the second inlet of which is connected directly and without a furnace for heating the liquid to the liquid outlet of said liquid/gas separator and the outlet of the mixing unit being connected to the inlet of (f) a hydrodesulfurization zone (g) said hydrocarbon preheater and said liquid/gas separator being built as one heat exchanger the last stage of which constitutes the gas/liquid separator having a gas outlet and a liquid outlet, said heat exchanger having a first flow path and a second flow path arranged in indirect heat exchange relationship with each other (h) said first flow path of said heat exchanger being connected with said hydrodesulfurization zone in such a manner as to allow at least a portion of the effluent of the hydrodesulfurization zone to flow through said first flow path, and said hydrocarbon feed conduit being connected to said second flow path.

2. Apparatus of claim 1 further comprising (i) a liquid level controller in said liquid/gas separator operatively connected to (j) a flow controller in the connection between said liquid outlet and said second inlet, (k) back pressure control means operatively connected to the connection between said outlet of said super heater and said mixing unit.

* * * * *